US011008799B2

(12) United States Patent
Simonton

(10) Patent No.: US 11,008,799 B2
(45) **Date of Patent: *May 18, 2021**

(54) DEAD STOP TYPE PROJECTION WINDOWS WITH SEAL MEMBERS FOR INSERT WINDOWS

(71) Applicant: David Brooks Simonton, Mineralwells, WV (US)

(72) Inventor: David Brooks Simonton, Mineralwells, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/275,865

(22) Filed: Feb. 14, 2019

(65) Prior Publication Data

US 2020/0263483 A1 Aug. 20, 2020

(51) Int. Cl.
*E06B 1/36* (2006.01)
*E06B 7/23* (2006.01)

(52) U.S. Cl.
CPC ..... *E06B 1/363* (2013.01); *E06B 1/366* (2013.01); *E06B 7/23* (2013.01)

(58) Field of Classification Search
CPC . E06B 1/363; E06B 1/366; E06B 7/23; E06B 7/2301; E06B 7/2305; E06B 7/2307; E06B 7/2309; E06B 7/231; E06B 7/16; E06B 7/21; E06B 7/22
USPC ..... 52/201
See application file for complete search history.

(56) References Cited

U.S. PATENT DOCUMENTS 1,152,899 A * 9/1915 Moore ..... E06B 7/28 47/40
1,214,057 A * 1/1917 Moore ..... E06B 7/28 47/40
1,804,787 A * 5/1931 Kullmer ..... E06B 7/22 49/489.1
2,074,872 A * 3/1937 Thorin ..... A47B 71/00 47/40
2,161,791 A * 6/1939 Bayley ..... E06B 3/6604 49/401
2,771,165 A * 11/1956 Bell ..... E06B 7/2301 52/717.02
3,067,845 A * 12/1962 Smith ..... E06B 1/363 52/456
3,074,125 A * 1/1963 Miller ..... E06B 1/363 52/63
3,127,697 A * 4/1964 Romenko ..... E06B 7/28 47/40

(Continued)

*Primary Examiner* — Kyle J. Walraed-Sullivan
(74) *Attorney, Agent, or Firm* — Porter, Wright, Morris & Arthur, LLP

(57) ABSTRACT

A dead stop type projection window assembly includes a free-standing frame and at least one independent insert window. The free-standing frame includes a top member, a base member spaced below the top member, at least two mullions vertically extending between the top member and the base member and spaced apart to form an insert window opening therebetween, and a stop extending along a perimeter of the insert window opening. The insert window is secured to the free-standing frame at the insert window opening. The free-standing frame further includes at least one preformed seal member engaging the insert window to seal closed the window frame opening with a wind/water tight seal. The preformed gasket can extend from the stop to the insert window and/or can extend from at least one of the mullions to the insert window.

20 Claims, 13 Drawing Sheets

(56) References Cited

U.S. PATENT DOCUMENTS 3,148,479 A * 9/1964 Amato ..... A01G 9/14 47/40
3,210,808 A * 10/1965 Creager ..... E04B 1/0046 52/204.705
4,038,791 A * 8/1977 Atkinson ..... A01G 9/14 312/102
4,068,433 A * 1/1978 Glover ..... E06B 3/10 52/207
4,132,035 A * 1/1979 Frambach ..... E06B 3/2605 49/381
4,251,964 A * 2/1981 Francis ..... E04D 3/08 52/204.593
4,314,424 A * 2/1982 Gordon ..... E06B 7/2312 49/400
4,497,137 A * 2/1985 Nelson ..... E06B 7/2314 49/495.1
4,571,899 A * 2/1986 Minter ..... E04D 3/14 52/395
4,663,896 A * 5/1987 Dunnick ..... E06B 1/363 52/201
4,686,805 A * 8/1987 Forslin ..... E04B 1/0046 49/DIG. 1
4,773,193 A * 9/1988 Biebuyck ..... E04B 1/0046 52/645
4,847,977 A * 7/1989 Gold ..... B60J 10/70 29/446
4,974,364 A * 12/1990 Durham, Jr. ..... E06B 1/366 49/400
5,099,623 A * 3/1992 Smith ..... E06B 1/363 52/201
5,117,587 A * 6/1992 Doan ..... E06B 7/2309 49/383
5,356,694 A * 10/1994 Knapp ..... E06B 7/22 428/163
5,568,707 A * 10/1996 Ishikawa ..... E04B 1/0046 52/200
5,584,143 A * 12/1996 Kennedy ..... A47F 3/043 49/501
5,836,117 A * 11/1998 Johnson ..... E04B 1/0046 52/201
5,987,826 A * 11/1999 Petta ..... E06B 1/02 52/204.5
6,244,001 B1 * 6/2001 Anastasi ..... E06B 1/003 49/504
6,427,397 B1 * 8/2002 Kolaschnik ..... E06B 3/308 52/204.1
6,729,082 B1 * 5/2004 Oldham ..... E06B 1/363 52/201
2002/0014044 A1 * 2/2002 Edger ..... E06B 1/363 52/201
2007/0137119 A1 * 6/2007 Guillemette ..... E06B 3/306 52/204.1
2009/0249694 A1 * 10/2009 Nilsson ..... E06B 1/6076 49/62
2012/0240492 A1 * 9/2012 Woodward ..... E06B 1/363 52/204.5
2016/0265270 A1 * 9/2016 Sawada ..... E06B 7/16
2018/0135347 A1 * 5/2018 Geier ..... E06B 7/2307
2019/0078380 A1 * 3/2019 McKenna ..... E06B 7/2303

* cited by examiner

DEAD STOP TYPE PROJECTION WINDOWS WITH SEAL MEMBERS FOR INSERT WINDOWS

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to projection windows and, more particularly, to sealing insert windows in dead stop type projection windows.

BACKGROUND OF THE INVENTION

The new construction and replacement window industry has been manufacturing or outsourcing projection windows such as, for example but not limited to, bay and bow windows for many years. These bay and bow windows can be designed in different ways. The most common type of bay/bow window is a vinyl mulled or capped bay/bow window. Another type of bay/bow window which is commonly supplied by specialized outsourcing companies is a "dead stop" type bay and bow window.

The dead stop type bay/bow windows are particularly good for companies who outsource these specialty window products because the insert windows can be installed by anyone after the frame is built. Additionally, the dead stop type bay/bow windows are universal in that any manufacturer's standard windows can be installed into the frame as the insert windows. However, some manufacturers may decide to build this type of frame in house too, due to the products exceptional qualities over the vinyl mulled or capped type bay/bow windows. The vinyl mulled or capped type bay/bow window designs require the frame to be finished/sealed during or after the insert windows are installed into the frame. These types of designs typically have shortcomings.

A dead Stop type bay/bow window has individual insert windows that are each installed against an exterior and/or interior stop(s) of a frame. To seal the insert windows to the frame and the overall assembly against wind and water infiltration, the insert windows are caulked or other sealants are used to create a seal. Typically, sealants are first applied to the dead stops and then the insert windows pushed into the sealant and against the dead stops (see FIGS. 1 and 2). The sealant can also be applied after installation of the insert windows or applied both before and after installation of the insert windows. The preferred and most common method is to apply sealant to the dead stops beforehand, install the insert windows against the dead stops, clean off the squeezed out sealant on the exterior side of the frame, and then finally apply one last uniform bead of sealant on the exterior side of the frame after installation of the insert windows.

These current method(s) do a sufficient job of sealing the insert windows into the frame if done correctly. However, caulking and other sealants have drawbacks. The most notable drawbacks being that sealants can attract dirt, change color, suffer degradation, and require maintenance when exposed to the environment over time. Additionally, caulking and other sealants need to be applied correctly, are messy, and take a lot of time to clean and manipulate. Furthermore, caulking and other sealants are often not applied thoroughly enough or are not applied in the right areas which can lead to sealing issues for the completed bay/bow window in the field. To combat these application issues, installers must be trained and retained to control against field sealant failures.

Accordingly, there is a need in the art for improved dead stop type projection windows and/or methods for installing insert windows into window frames of dead stop type projection windows.

SUMMARY OF THE INVENTION

Disclosed are improved dead stop type projection windows and/or methods for installing insert windows into window frames of dead stop type projection windows which address one or more issues of the related art. Disclosed is a dead stop type projection window assembly comprising, in combination, a free-standing frame and an insert window secured to the free-standing frame at an insert window opening of the frame. The free-standing frame includes a top member, a base member spaced below the top member, at least two mullions vertically extending between the top member and the base member and spaced apart to form an insert window opening therebetween, and a stop extending along at least a portion of a perimeter of the insert window opening. The free-standing frame further includes at least one preformed seal member engaging the insert window to seal closed the window frame opening.

Also disclosed is a dead stop type projection window frame for receiving at least one independent insert window comprising, in combination, a top member, a base member spaced below the top member, at least two mullions vertically extending between the top member and the base member and spaced-apart to form an insert window opening therebetween, a stop extending along at least a portion of a perimeter of the insert window opening, and at least one preformed seal member configured to engage the insert window when the insert window is closing the insert window opening to seal closed the window frame opening.

Further disclosed is a method of assembling a dead stop type projection window assembly comprising the steps of, in combination, obtaining a free-standing frame including a top member, a base member spaced below the top member, at least two mullions vertically extending between the top member and the base member and spaced apart to form an insert window opening therebetween, a stop extending along at least a portion of a perimeter of the insert window opening, and at least one preformed seal member configured to engage the insert window when the insert window is closing the insert window opening to seal closed the window frame opening, and obtaining an insert window. The insert window is inserted into the free-standing frame at the insert window opening and pushing the insert window toward at the stop to so that the insert window engages the preformed seal member to form a seal between the insert window and the free-standing frame, and the insert window is secured to the free-standing frame.

From the foregoing disclosure and the following more detailed description of various preferred embodiments it will be apparent to those skilled in the art that the present invention provides a significant advance in the technology and art of dead stop type projection windows and/or methods for installing insert windows into window frames of dead stop type projection windows. Particularly significant in this regard is the potential the invention affords for improving the seal between the insert windows and the window frame with major cost reduction and reduced labor requirements. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
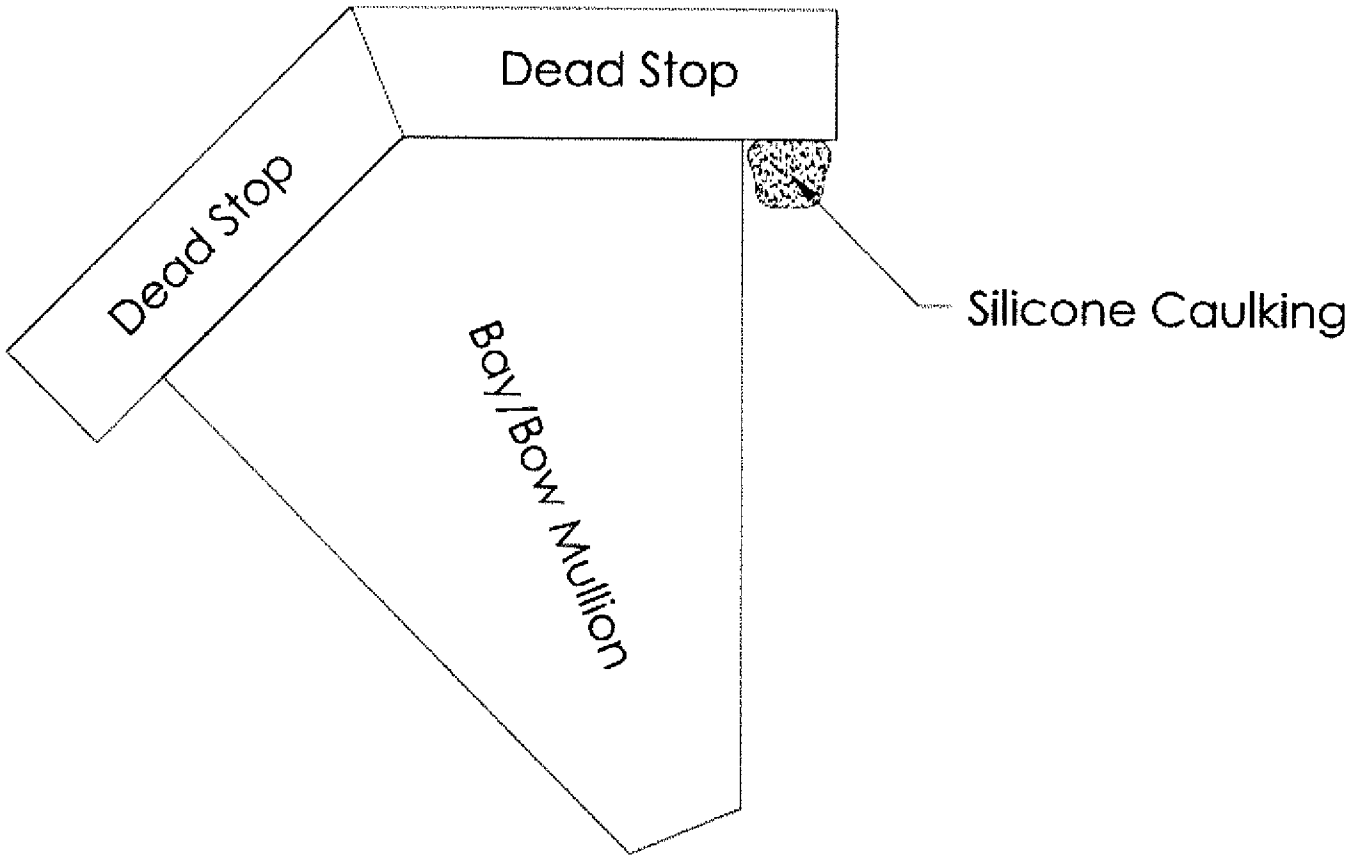
Figure 1 (Prior Art)
FIG. 1 is a diagrammatic top view showing a dead stop of a dead stop type bay/bow window frame according to the prior art.
Figure 2:
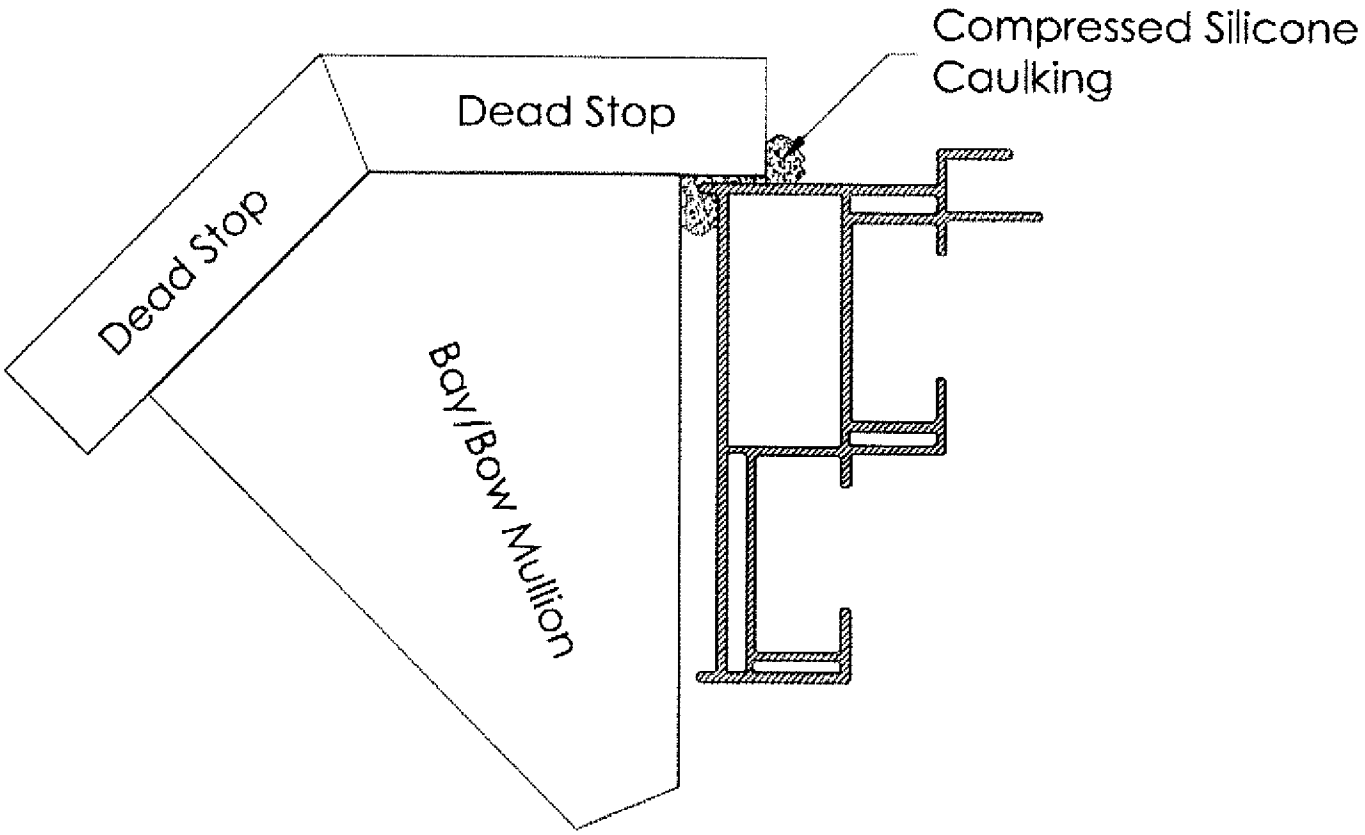
Figure 2 (Prior Art)
FIG. 2 is a diagrammatic top view showing the dead stop of FIG. 1 but wherein an insert window is installed against the dead stop to show where the sealant flows during installation.

It should be understood that the appended drawings are not necessarily to scale, presenting a somewhat simplified representation of various preferred features illustrative of the basic principles of the invention. The specific design features of the dead stop type bay/bow windows as disclosed herein, including, for example but not limited to, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example but not limited to, for clarity or illustration. All references to direction and position, unless otherwise indicated, refer to the orientation of the structures illustrated in the drawings. In general, up or upward generally refers to an upward direction within the plane of the paper in FIG. 3 and down or downward generally refers to a downward direction within the plane of the paper in FIG. 3. In general, front or forward generally refers to a direction into the plane of the paper in FIG. 3 and rear or rearward generally refers to a direction out of the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the dead stop type projection window structures and methods related thereto that are disclosed herein. The following detailed discussion of various alternative and preferred embodiments will illustrate the general principles of the invention using an exemplar dead stop type bay window. Other embodiments suitable for other applications will be apparent to those skilled in the art given the benefit of this disclosure such as, for example but not limited to, bow windows and other projection windows.

Referring now to the drawings, FIGS. 3 to 7 show dead stop type projection window assembly according to a first embodiment of the present invention. The illustrated dead stop type projection window assembly 10 includes a free-standing frame 12 forming at least one insert window opening 14, and at least one insert window 16 secured to the free-standing frame 12 at the insert window opening 14 to generally close the insert window opening 14 in the free-standing frame 12. The free-standing frame 12 further includes at least one preformed seal member 20 engaging the insert window to seal the window frame opening. The free standing frame 12 forms a dead stop or stop 22 at least partially surrounding, and preferably entirely surrounding, the insert window opening 14 for engagement with the insert window 16. Sealed in this manner it is not required to utilize a sealant 18 as is typical to fill or close at least a portion of any gap formed between the insert window 16 and the free-standing frame 12. The sealant 18 typically used is caulk or caulking. It is noted that, however, that the sealant 18 can be utilized in conjunction with the at least one preformed seal member such as, for example but not limited to, a dab or bead of the sealant 18 placed at corners or other joints between adjacent ones of the preformed seal members 20. The term "preformed seal member" is used herein and in the claims to mean a seal member that is formed prior to the installation of the insert window into the frame and forms a seal during installation of the insert window into the frame, unlike sealant that is applied during installation of the insert window into the frame and forms a seal upon curing after installation of the insert window into the frame. The term "sealant" is used herein and in the claims to mean a substance that is flowable during application and is used to block the passage of fluids through the gap between the dead stop and the insert window once cured. The term "caulk" or caulking" is used herein and in the claims to mean a flexible sealant used to close or fill gaps to prevent or reduce the passage of water, air, dust, insects, and/or noise therethrough and are often applied using a caulking gun or squeeze bottle. Most caulk or caulking currently sold is a ready-mixed construction chemical such as, for example but not limited to, silicone, polyurethane, polysulfide, sylil-terminated-polyether or polyurethane, acrylic, and the like and cures within about 24 hours.

The term "projection window" is used herein and in the claims to mean a window assembly that forms a three dimensional space or bay that extends or projects outward from a wall of a building such as, for example but not limited to, bay windows, bow windows, garden windows, oriel windows, and the like. The term "dead stop" or "stop" is used herein and in the claims to mean an internal or external abutment formed by the frame extending along at least a portion of the edge or perimeter of the insert window opening which the insert is pushed against during installation of the insert window to the frame. The term "sealant" is used herein and in the claims to mean a substance used to block the passage of fluids through the gap between the dead stop and the insert window. The term "caulk" or caulking" is used herein and in the claims to mean a flexible sealant used to close or fill gaps to prevent or reduce the passage of water, air, dust, insects, and/or noise therethrough and are often applied using a caulking gun or squeeze bottle because such flexible sealants are initially flowable. Most caulks or caulking currently sold are ready-mixed construction chemicals such as, for example but not limited to, silicone, polyurethane, polysulfide, sylil-terminated-polyether or polyurethane, acrylic, and the like.

Figure 3:
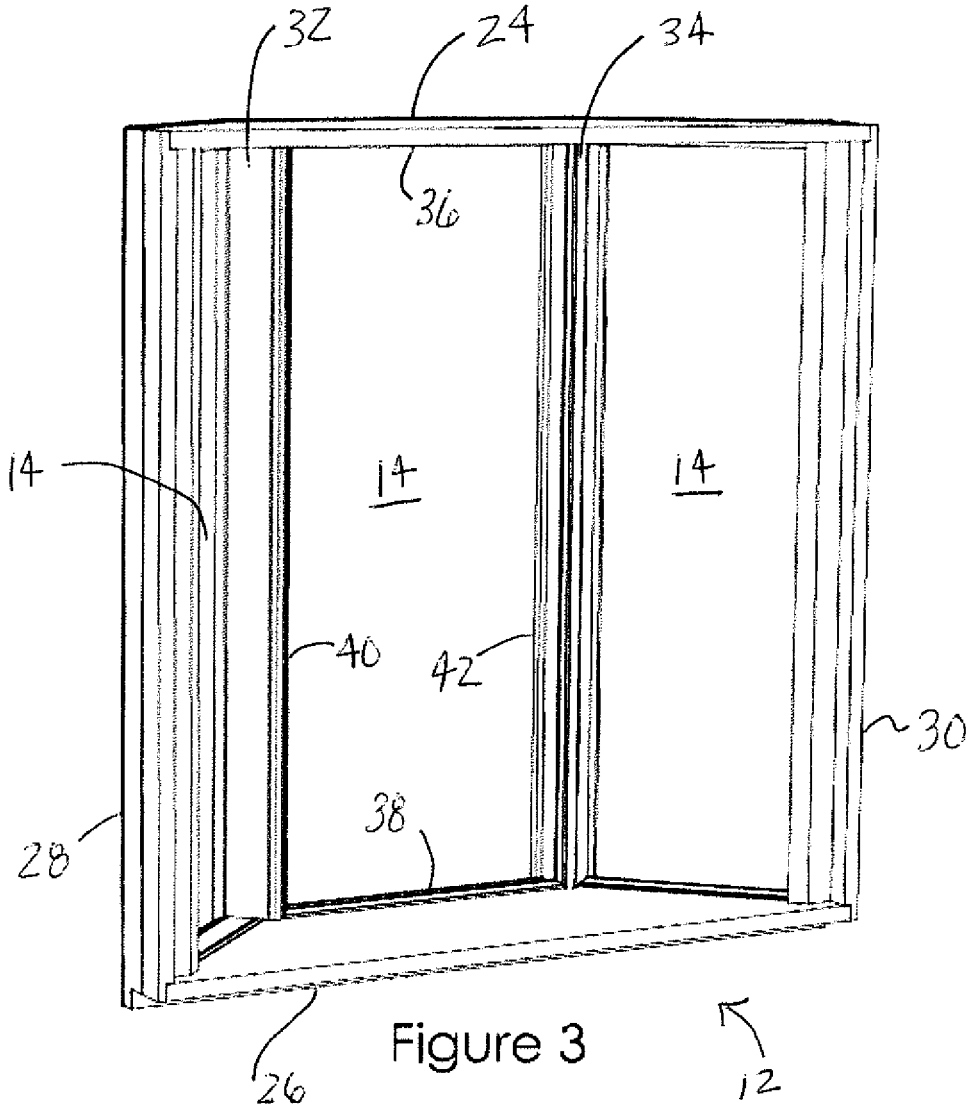
FIG. 3 is a perspective view showing a free-standing frame of a dead stop type bay window frame according to a first embodiment of the present invention.
Figure 4:
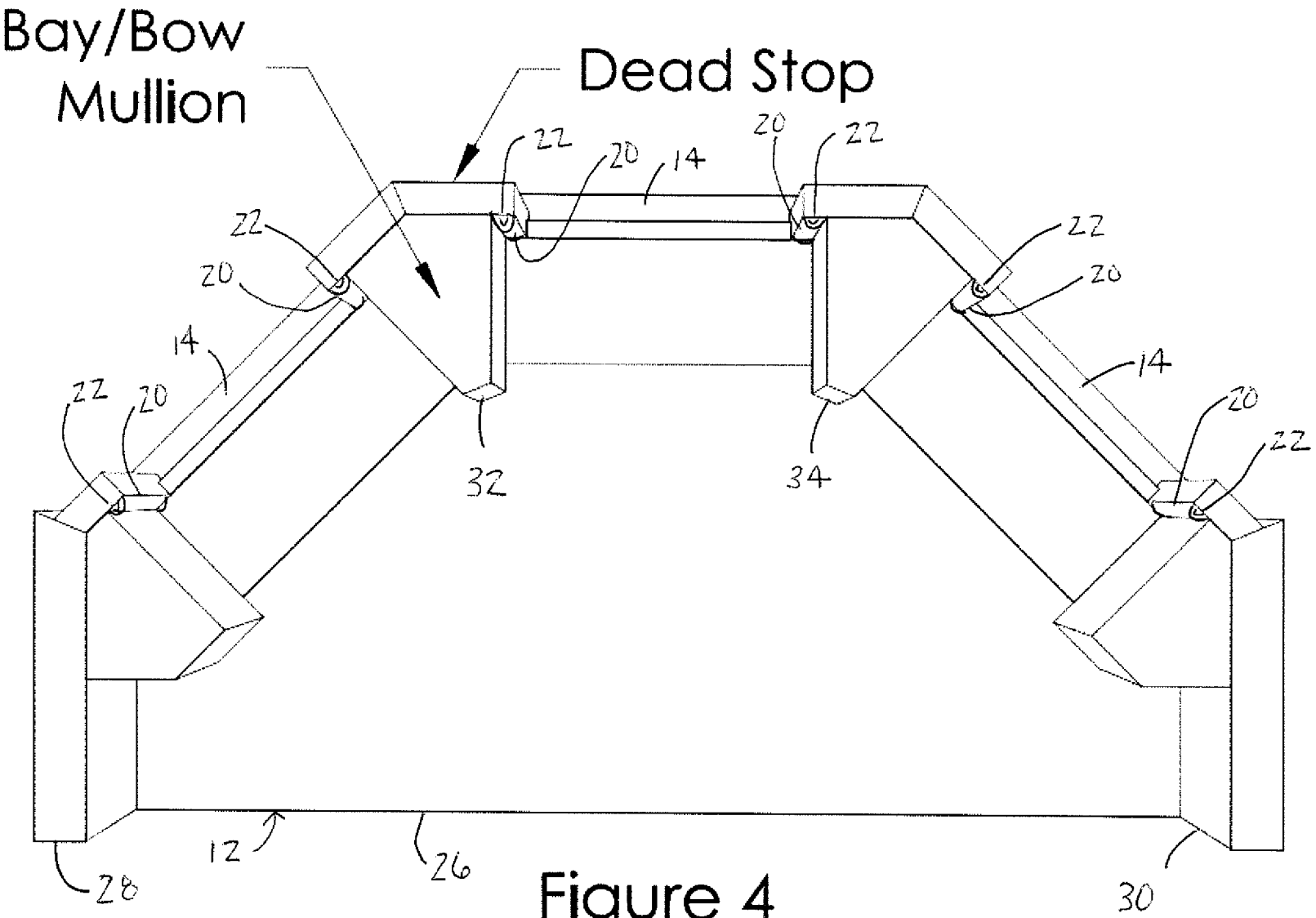
FIG. 4 is a fragmented sectional view of the free-standing frame of FIG. 3 at one opening for an insert window.
Figure 5:
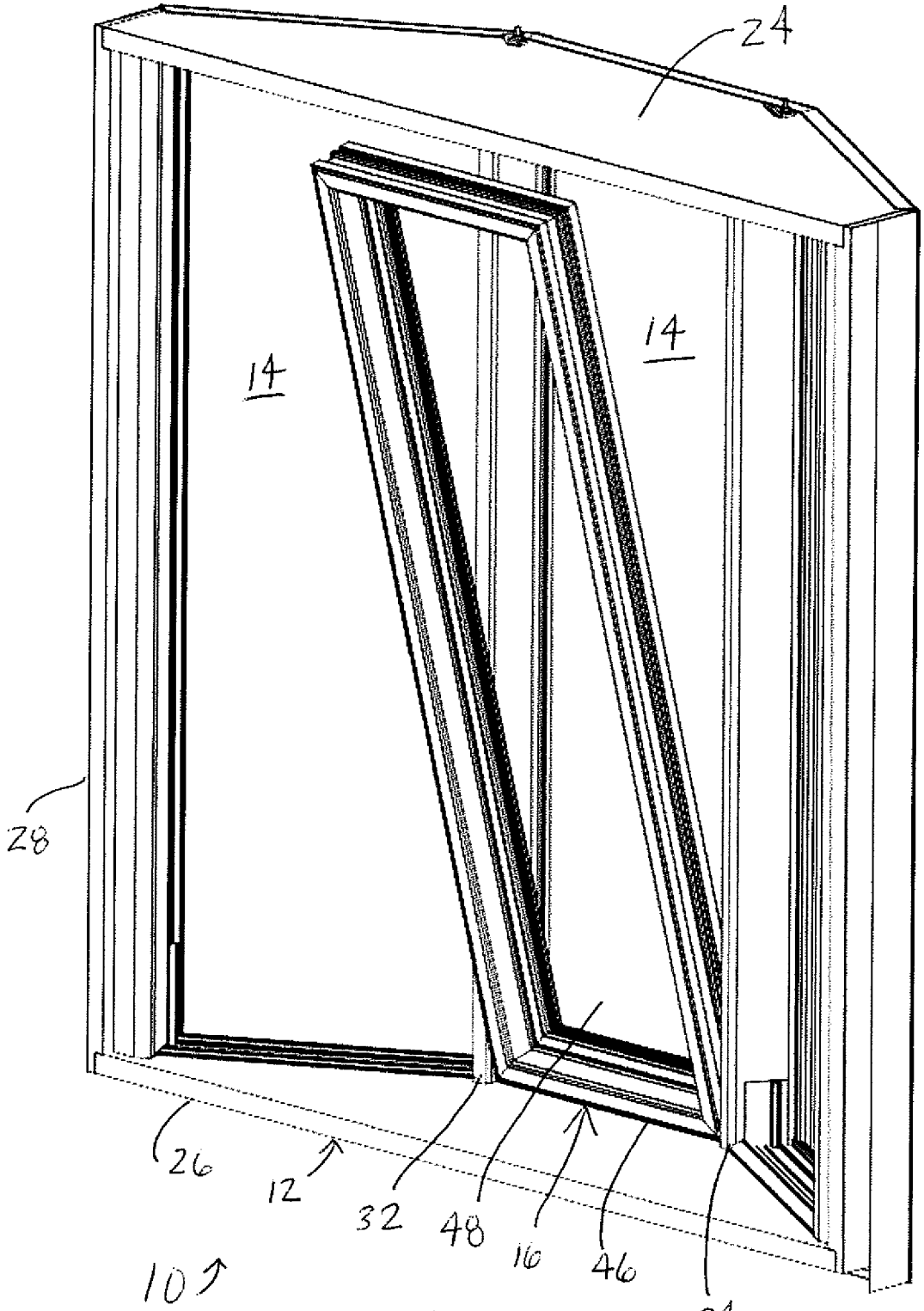
FIG. 5 is a diagrammatic view of the free-standing frame of FIG. 3 with an insert window being positioned into an opening of the frame.
Figure 6:
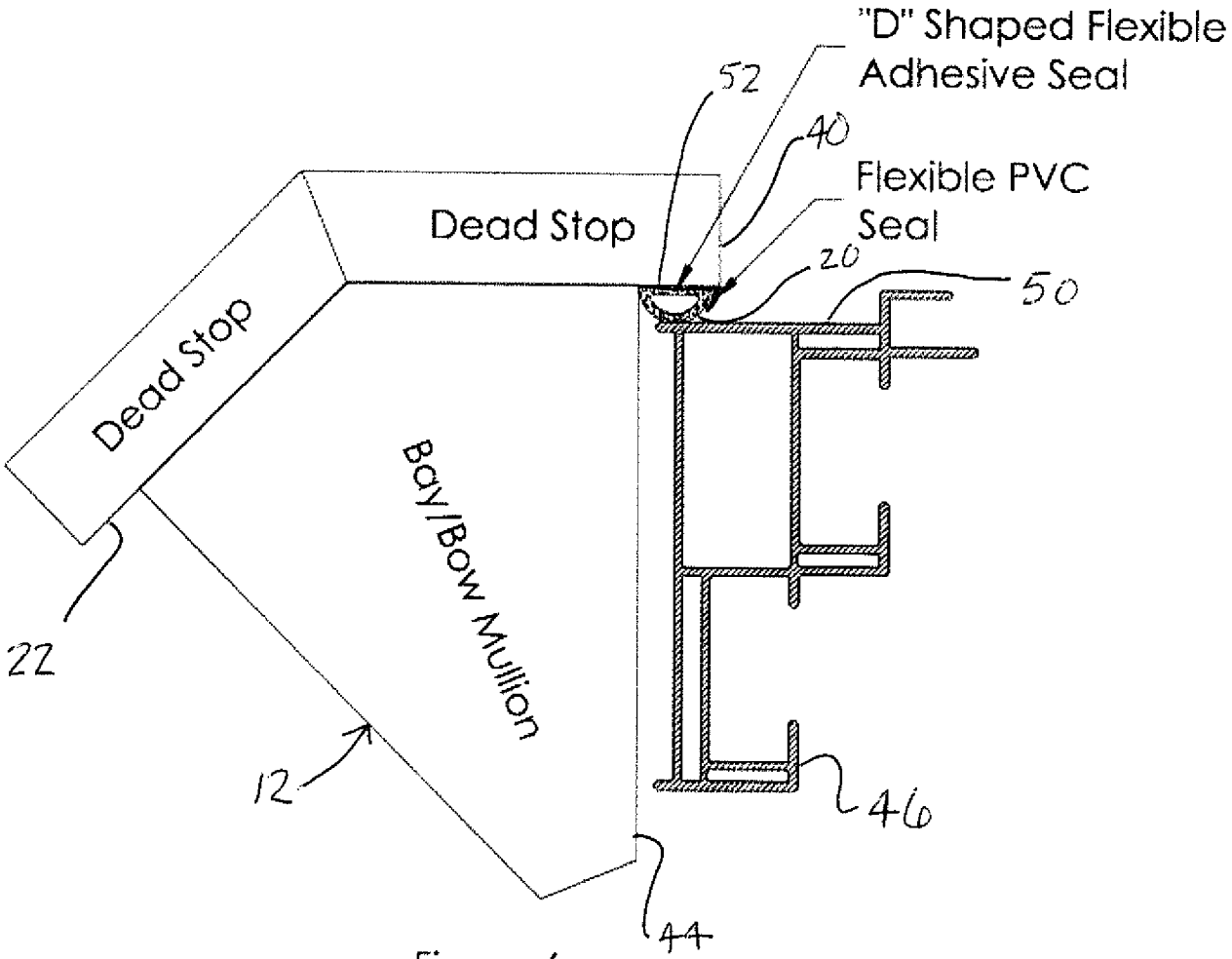
FIG. 6 is a diagrammatic top view showing a dead stop at the frame opening of FIG. 5, wherein a preformed seal member is provided (in the form of a D-shaped compressible gasket) to provide a wind/water tight seal at the insert window opening between the stop and the insert window without the use of a flowable sealant.
Figure 7:
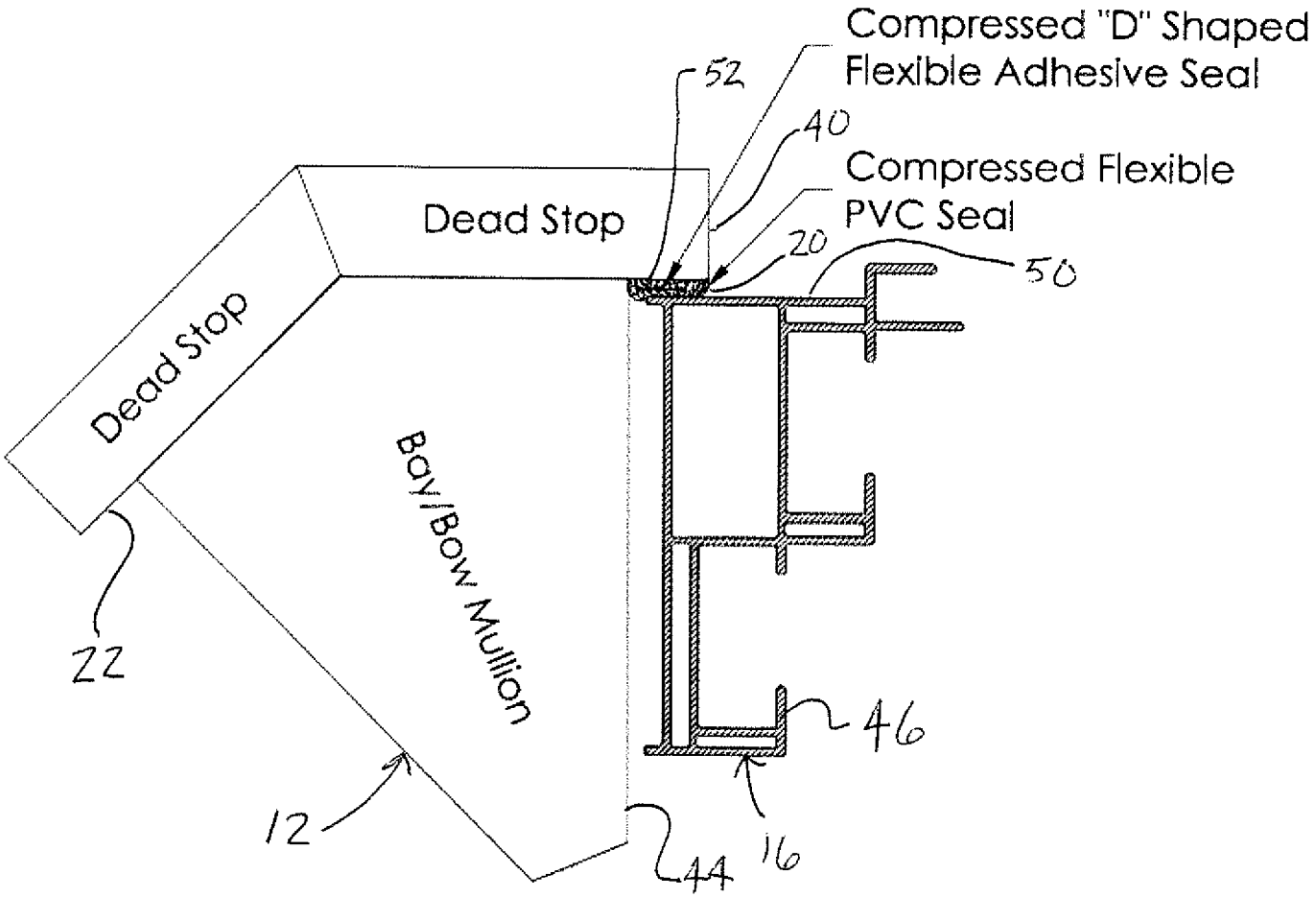
FIG. 7 is a diagrammatic top view showing the dead stop of FIG. 6 but wherein the insert window is fully installed against the dead stop and the preformed seal member is compressed to form the wind/water tight seal at the insert window opening between the stop and the insert window without the use of a flowable sealant.

As best seen in FIGS. 3 and 4, the illustrated free-standing frame 12 includes a top horizontally-extending structural member 24, a base or bottom horizontally structural member 26 spaced below the top structural member 24, vertically-extending left and right end structural members or mullions 28, 30 connecting left and right ends of the top and bottom structural members 24, 26, and two vertically-extending intermediate structural members or mullions 32, 34 connecting the top and bottom structural member members 24, 26 between the left and right end structural members 38, 30. The intermediate structural members 32, 34 are laterally spaced apart from each other and the left and right end structural members 28, 30 to form three laterally adjacent insert window openings 14 where the laterally outward or left and right side insert window openings 14 form an obtuse angle with the center insert opening 14. It is noted that other quantities of the intermediate structural members 23, 34 can be utilized to form other quantities of the insert window openings 14 such as for example but not limited to, one intermediate mullion 32, 34 to form two adjacent window openings 14, three intermediate mullions 32, 34 to form four insert window openings 14, and the like. The illustrated insert window openings 14 each have a rectangular shaped perimeter formed by horizontally-extending top and bottom edges 36, 38 connected by vertically-extending left and right edges 40, 42. It is noted that the insert window openings 14 can alternatively have any suitable configuration, size, and/or shape and are preferably sized and shaped to receive independent insert windows 16. The term "independent insert windows" is used herein and in the claims to mean a window that is a standard or off-the-shelf window that can be used independent of the free-standing frame 12 if desired such as, for example but not limited to, a standard window opening in a building exterior wall. The use of an independent insert window 16 enables the installer to select any suitable standard or off-the-shelf window to be used as the insert window 16 rather than being limited to using only a special insert window uniquely manufactured or customized to be used with the free-standing frame 12.

The illustrated free-standing frame 12 also includes the internal and rearward facing dead stops or stops 22 extending about the entire perimeter of the insert window openings 14. The illustrated dead stops 22 permit each of the insert windows 16 to be installed to the free-standing frame 12 from the interior side of the free-standing frame 12 and pushed against the dead stop 22 (best seen in FIG. 5). It is noted that the dead stops 22 can alternatively be external and outward facing to permit each of the insert windows 16 to be installed to the free-standing frame 12 from the exterior side of the free-standing frame 12. It is also noted that the dead stops 22 can have any other suitable configuration such as, for example but not limited to, extending along less than the entire perimeter of the insert window openings 14. The illustrated dead stops 22 are configured to form an abutment or stop for the insert window 16 to engage. The illustrated dead stops 22 are each a planar surface parallel with the insert window opening 14 and have a width suitable for forming a seat and a seal for the insert windows 16 but any other suitable configuration can alternatively be utilized. The illustrated mullions 28, 30, 32, 34 form inwardly-extending walls 44 at edges of the dead stops 22 opposite the perimeter of the insert window openings 14. The illustrated walls 44 form acute angles with the dead stops 22 and form a gap or passage between the walls 44 and sides 45 of the insert windows 16 as further described herein below.

The illustrated top structural member 24, bottom structural member 26, left and right end structural members or mullions 28, 30, and the intermediate structural members or mullions 32, 34 each comprise wood but any other suitable materials or combination of materials can be utilized such as for example but not limited to, aluminum or other suitable metals, nylon or other suitable polymers, and the like. The illustrated structural members 24-34 are solid and sized and shaped so that the frame 12 is free-stand or self-supporting. The illustrated dead stops 22 are formed by extrusions secured to the structural members 24-34. The illustrated extrusions are formed of vinyl and are attached by mechanical means such as, for example but not limited to, nails, screw, and the like. It is noted, however, that the extrusions can comprise any other suitable material and/or can be attached to the structural members 24-34 in any other suitable manner. It is also noted that the dead stops 22 can be formed in any other suitable manner.

The illustrated preformed seal member 20 extends inwardly from the stop 22 and is adapted to engage the insert window 16 to form a wind and water tight seal therewith at the insert window opening 14. The illustrated preformed seal member 20 is a D-shaped flexible seal that compresses when engaged by the insert window 16 to form a seal therebetween. It is noted that any other suitable type of flexible and/or compressible preformed seal member 20 can alternatively be utilized. While the illustrated preformed seal member 20 is D-shaped, the preformed seal member 20 can alternatively have any suitable shape or combination of shapes such as, for example but not limited to, "D", square, rectangle, bulb, angled bulb, flaps, hollow bulb, foam filled bulb, hollow rectangle/square, foam filled rectangle/square, pile seals, and/or sweeps, and the like. The illustrated preformed seal member 20 is attached to the stop 22 with adhesive 52. However, the preformed seal member 20 can be mounted or integrated in any suitable manner such as, for example but not limited to, direct extrusion, co-extrusion, pre-applied, post applied, glued, stapled, slot mounted, and the like. The preformed seal member 20 can comprise any suitable UV resistant, water resistant, water proof, and/or weather resistant material such as, for example but not limited to, EDPM rubber, Neoprene, Silicone, PVC, TPE (Thermoplastic Elastomers), Nitrile PVC, Silicone PVC, Nitrile, Foam, Q-lon Foam, polyethylene, urethane, and the like.

The illustrated dead stops 22 are provided with the preformed seal members 20 to extend along at least two edges 36, 38, 40, 42 of each of the insert window openings 14. Preferably, at least the lateral left and right edges 40, 42 of each of the insert window openings 14 are provided with the preformed seal members. It is noted that the dead stops 22 can alternatively be provided with the preformed seal members 20 to extend along at least three edges 36, 38, 40, 42 of each of the insert window openings 14. Preferably, at least the top, lateral left, and lateral right edges 36, 40, 42 of each of the insert window openings 14 are provide with the preformed seal members 20. It is further noted that the dead stops 22 can alternatively be provided with the preformed seal members 20 to extend along all four edges 36, 38, 40, 42 of each of the insert window openings 14, which are rectangular-shaped in the illustrated embodiment, to extend entirely around each of the insert window openings 14.

The insert windows 16 each include a rectangular-shaped window frame 46 extending about the periphery of at least one window pane 48. The window frame 46 forms an engagement surface 50 sized and shaped to cooperate with and be pushed against the dead stop 22 of the free-standing frame 12 during installation. The illustrated engagement surface 50 extends about the entire perimeter of the window frame 46 and is configured to form a wind and water tight seal with the dead stop 22 via the seal member located therebetween to seal closed the insert window opening 14. The illustrated engagement surface 50 is a planar surface substantially parallel with the dead stop 22 but any other suitable configuration can alternatively be utilized. The insert window 16 is preferably an independent insert window 16. Importantly, the illustrated preformed seal members 20 do not require any different form or alteration of the insert windows 16.

Figure 8:
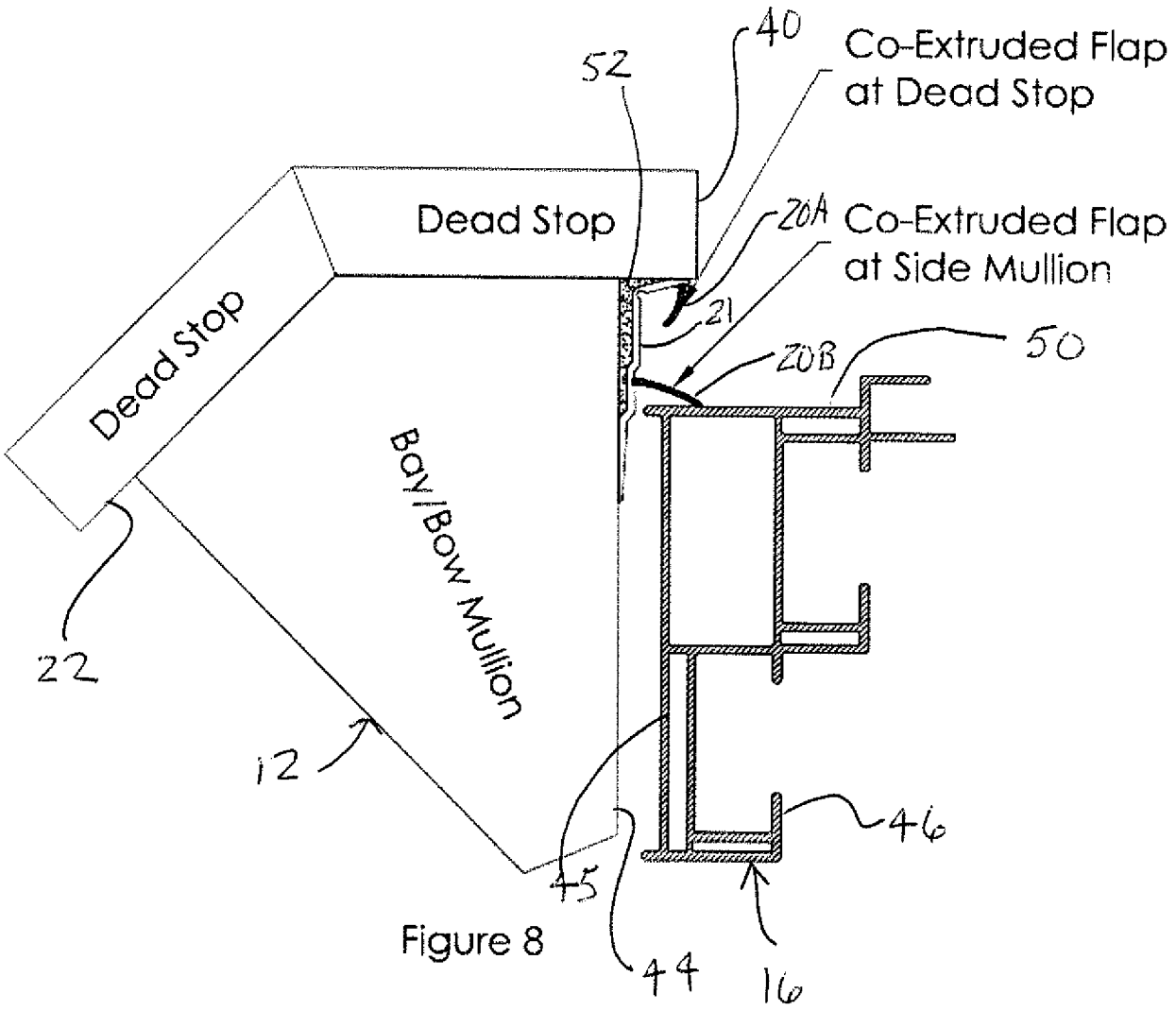
FIG. 8 is a diagrammatic top view showing a dead stop in at the frame opening similar to FIG. 6 but according to a second embodiment of the present invention, wherein the preformed seal member is in the form of a co-extruded flap at the dead stop along with an interior co-extruded flap at a side of the mullion.
Figure 9:
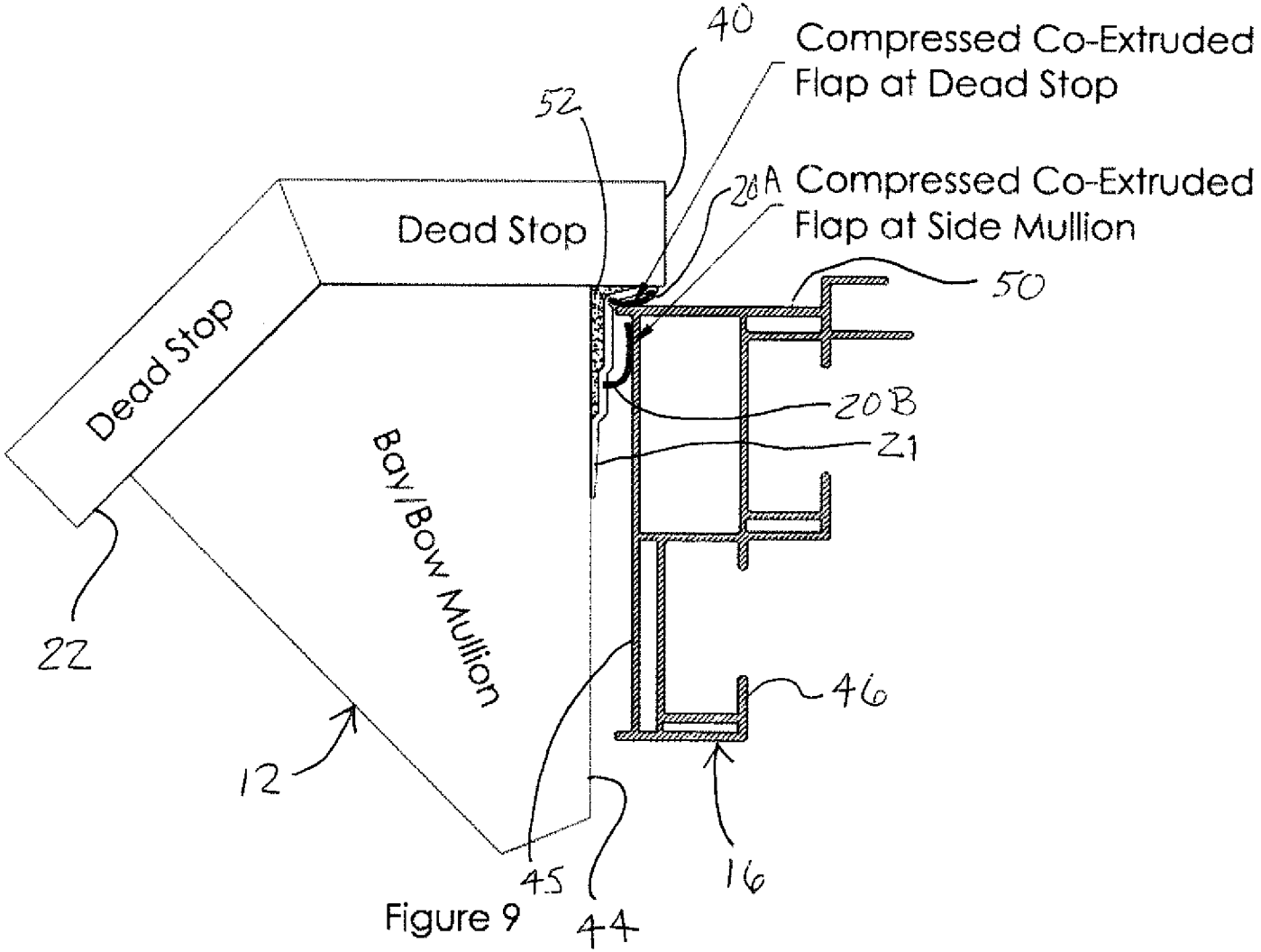
FIG. 9 is a diagrammatic top view showing the dead stop of FIG. 8 but wherein the insert window is fully installed against the dead stop and the preformed seal members are engaged to form the wind/water tight seal at the insert window opening between the stop and the insert window without the use of a flowable sealant.

FIGS. 8 and 9 show a dead stop type projection window assembly 100 according to a second embodiment of the present invention. The second embodiment of the present invention is substantially the same as the first embodiment described above except that the first preformed seal member 20A is a flexible member that bends when pushed by the insert window 16 to form the seal rather than a compressible member that compresses when pushed by the insert window 16 to form the seal. The illustrated first preformed seal member 20A is a flap seal or the like co-extruded with a base member 21. The illustrated base member 21 is secured to the mullion 2S such that the first preformed seal member 20A extends rearwardly from the dead stop 22 such that it is engaged by the engagement surface 50 of the window frame 46 to form a seal therebetween. The illustrated first preformed seal member 20A extends from a secured end located at or near the edge 36, 38, 40, 42 of the insert window opening 14 to a free end engaging the insert window 16 with a concave side facing the mullion wall 44. The base member 21 can be secured to the mullion 28 with adhesive 52 or the like. It is noted that the first preformed seal member 20A can alternatively have any other suitable shape, can be secured in any other suitable manner and at any other suitable location, and can comprise any suitable material.

The second embodiment of the present invention also includes a second preformed seal member 20B extending from the lateral side wall 44 of the mullion 28 inward of the first preformed seal member 20A to illustrate that there can be a plurality of the preformed seal members 20A, 20B at any suitable location. The illustrated second preformed seal member 20B is a flap seal or the like that is co-extruded with the base member 21. The second preformed seal member 20B extends laterally from the mullion wall 44 and toward the side 45 of the insert window frame 46 such that it is engaged by the side 45 of the window frame 46 to form a seal therebetween. The illustrated second preformed seal member 20B extends from a secured end to a free end engaging the insert window 16 with a concave side facing rearwardly when not engaged by the insert window 16. It is noted that the second preformed seal member 20B can have any other suitable shape, can alternatively be secured in any other suitable manner and at any other suitable location, and can comprise any suitable material. It is noted that either of the first or second preformed seal members 20A, 20B can be eliminated if desired or addition preformed seal members 20 can be add if desired.

Figure 10:
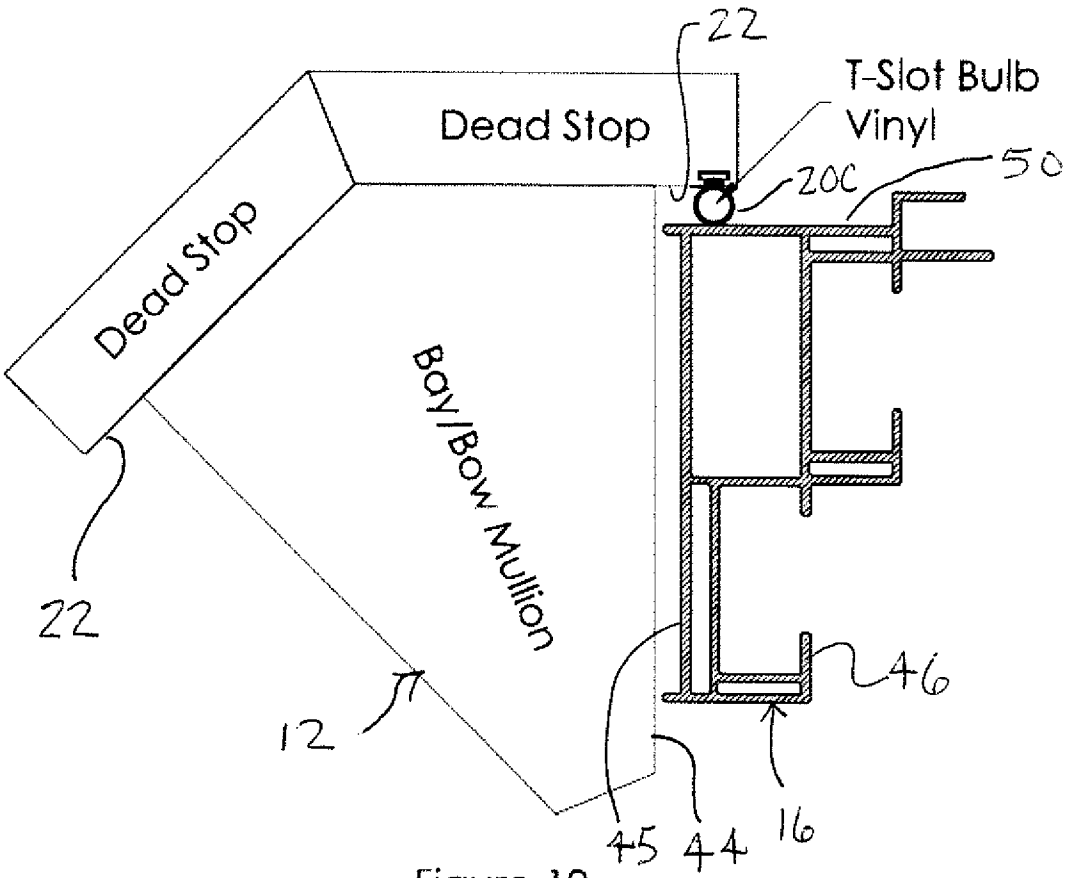
FIG. 10 is a diagrammatic top view showing a dead stop at the frame opening similar to FIG. 6 but according to a third embodiment of the present invention, wherein the preformed seal member is in the form of a T-slot applied bulb vinyl at the dead stop.
Figure 11:
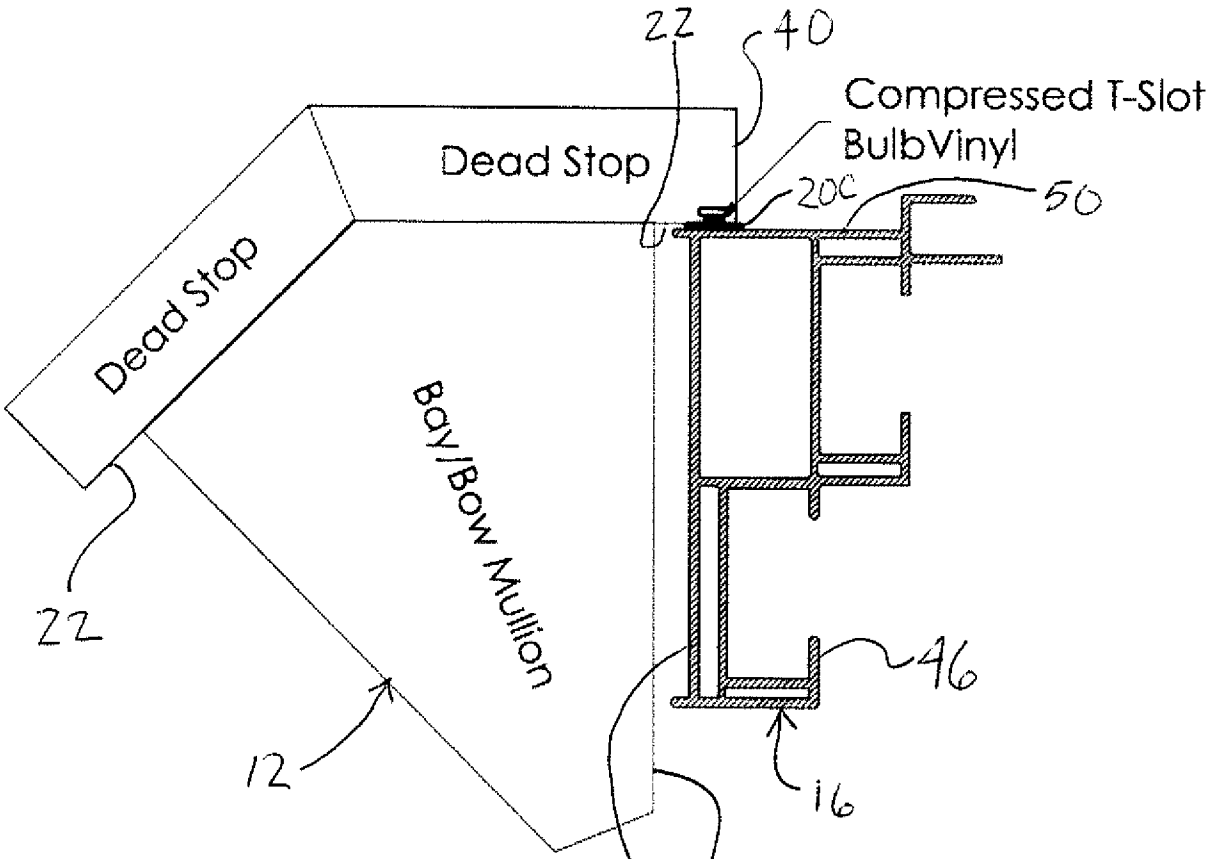
FIG. 11 is a diagrammatic top view showing the dead stop of FIG. 10 but wherein the insert window is fully installed against the dead stop and the preformed seal member is engaged to form the wind/water tight seal at the insert window opening between the stop and the insert window without the use of a flowable sealant.

FIGS. 10 and 11 show a dead stop type projection window assembly according to a third embodiment of the present invention. The third embodiment of the present invention is substantially the same as the first and second embodiments described above except that the preformed seal member 20C is a T-slot type bulb seal comprising vinyl. The illustrated preformed seal member 20C has a hollow and bulb-shaped seal portion and a T-shaped attachment portion extending from a forward side of the seal portion. The preformed seal member 20C is secured to the dead stop 22 such that the preformed seal member 20C extends rearwardly from the dead stop 22 to be engaged by the engagement surface 50 of the window frame 46 to form a seal therebetween. The illustrated preformed seal member 20C extends from at or near the edge 36, 38, 40, 42 of the insert window opening 14. The illustrated stop 22 is provided with a T-shaped slot sized and shaped for receiving the attachment portion of the preformed seal member 20C to secure the preformed seal member 20C to the stop 22. It is noted that the preformed seal member 20C can alternatively have any other suitable shape, can be secured in any other suitable manner and at any other suitable location, and can comprise any suitable material.

Figure 12:
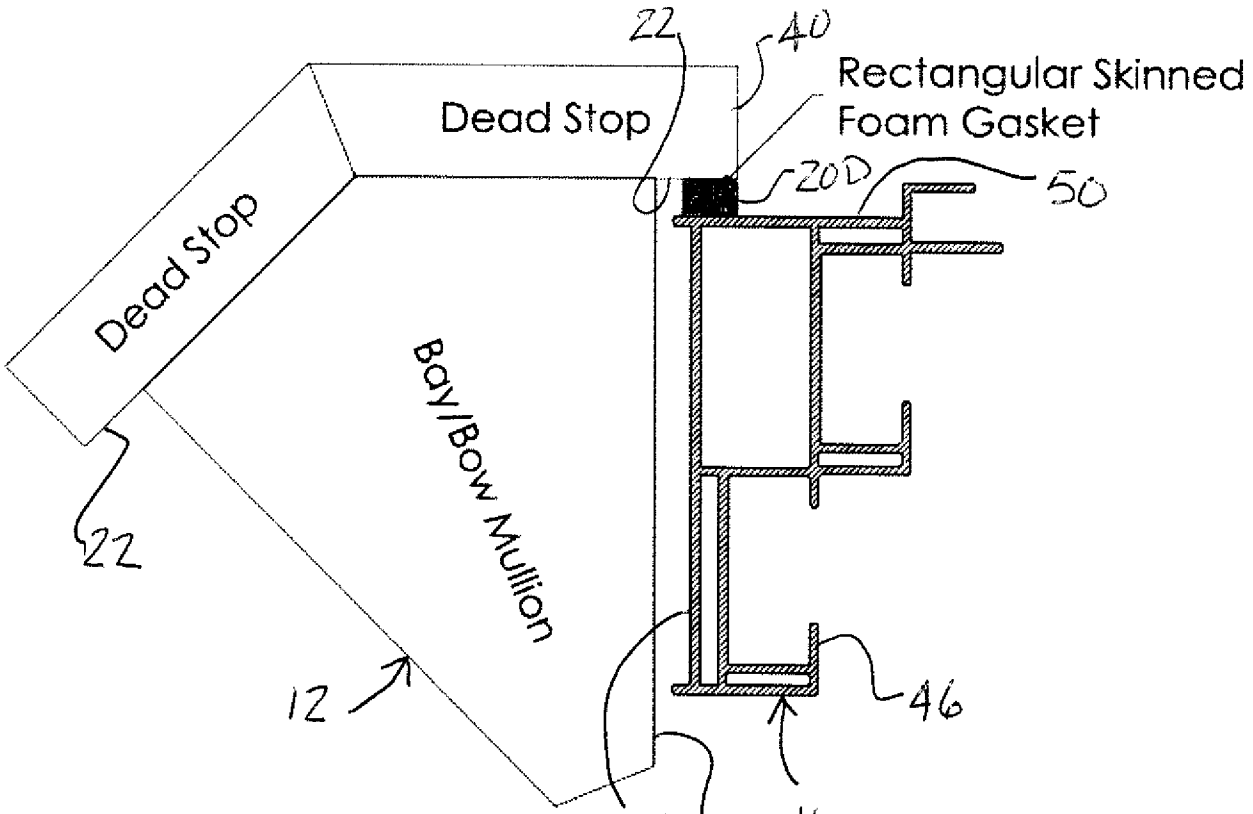
FIG. 12 is a diagrammatic top view showing a dead stop at the frame opening similar to FIG. 6 but according to a fourth embodiment of the present invention, wherein the preformed seal member is in the form of a rectangular-shaped skinned foam gasket at the dead stop.
Figure 13:
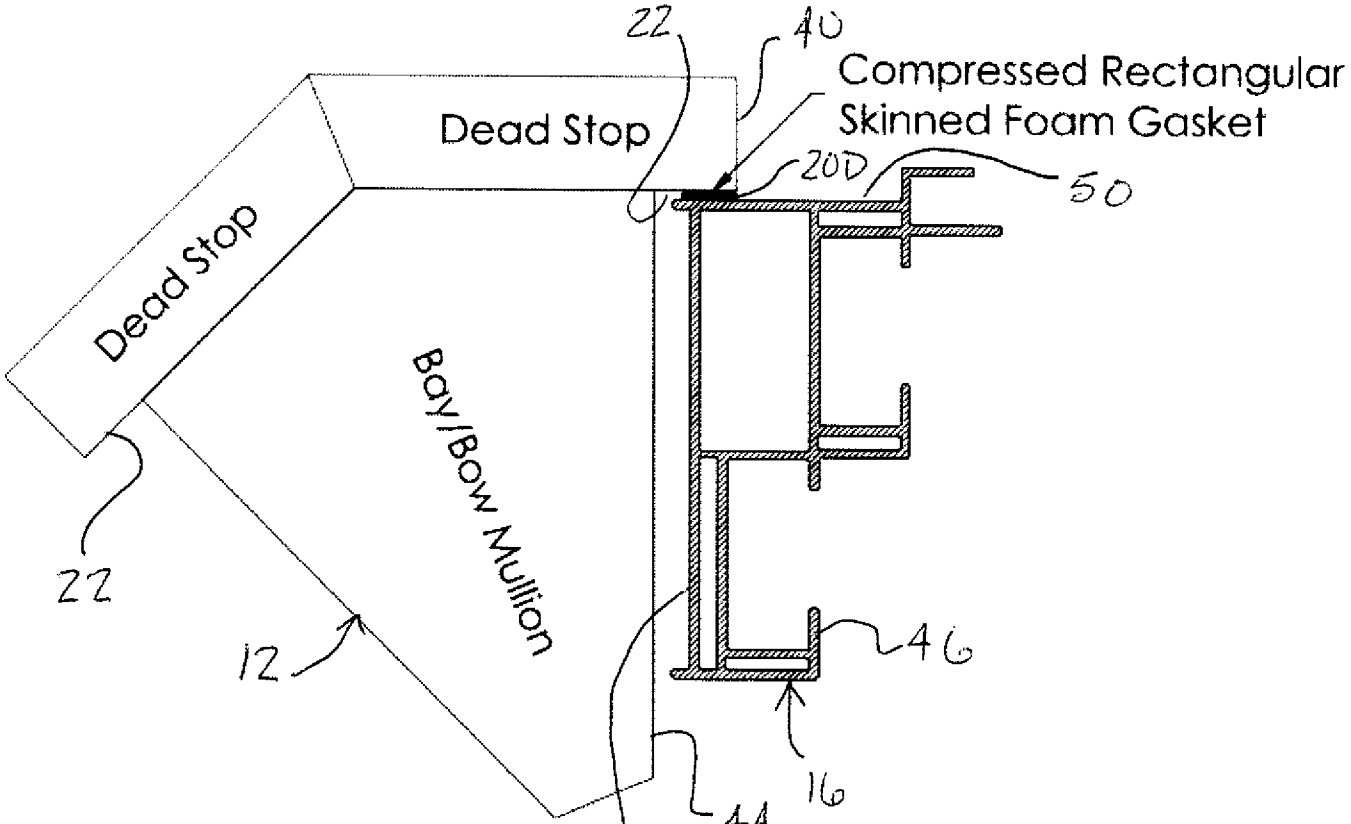
FIG. 13 is a diagrammatic top view showing the dead stop of FIG. 12 but wherein the insert window is fully installed against the dead stop and the preformed seal member is engaged to form the wind/water tight seal at the insert window opening between the stop and the insert window without the use of a flowable sealant.

FIGS. 12 and 13 show a dead stop type projection window assembly according to a fourth embodiment of the present invention. The fourth embodiment of the present invention is substantially the same as the first to third embodiments described above except that the preformed seal member 20D is a skinned-foam gasket. The illustrated preformed seal member 20D is rectangular-shaped but can alternatively have any other suitable shape. The illustrated preformed seal member 20D has an interior portion of compressible foam surrounded by a skin or covering to protect the foam. The preformed seal member 20D is secured to the dead stop 22 such that the preformed seal member 20D extends rearwardly from the dead stop 22 to be engaged and compressed by the engagement surface 50 of the window frame 46 to form a seal therebetween. The illustrated preformed seal member 20D extends from at or near the edge 36, 38, 40, 42 of the insert window opening 14. It is noted that the preformed seal member 20D can alternatively have any other suitable shape, can be secured in any other suitable manner and at any other suitable location, and can comprise any suitable materials.

To install the insert window or windows 16 into the free-standing frame 12, the installer inserts the insert window 16 into the free-standing frame 12 at the insert window opening 14 to engage the window frame engagement surface 50 or the window frame side 45 with the preformed seal member(s) 20, 20A, 20B, 20C, 20D on the stop 22 and/or the mullion wall 44 to sealingly close the insert window opening 14. The preformed seal member(s) 20, 20A, 20B, 20C, 20D forms a wind/water tight seal between the insert window 16 and the free-standing frame 12. If desired, sealant can be also applied where needed to fully form a seal between the frame 12 and the insert window such as, for example but not limited to, dabs or bulbs of sealant at corner joints between the separate adjacent seal members. The insert window 16 is then secured to the free-standing frame 12.

By providing the preformed seal member(s) 20, 20A, 20B, 20C, 20D along the window opening edges 36, 38, 40, 42, without any extensive use of a flowable sealant, the overall performance, look, and ease of use of the dead stop type projection window is improved.

Additionally, the preformed seal member(s) 20, 20A, 20B, 20C, 20D prevents the mess associated with traditional sealant only installations. The insert window installation time is reduced by 25% or more by the preformed seal member(s) 20, 20A, 20B, 20C, 20D. The preformed seal members 20, 20A, 20B, 20C, 20D make the installation of the insert windows 16 both easier to do and much less messy. Furthermore, the installation no longer requires the application of sealant and the clean-up and re-beading of sealant on the exterior of the projection window assemblies 100 where the dead stop 22 and insert window 16 meet.

Furthermore, the seal between the insert window 16 and the free-standing frame 12 is maintained much longer because there are no exposed sealants which require maintenance. The seal members 20, 20A, 20B, 20C, 20D inside of the assembly are protected from exposure making them last much longer.

Moreover, the preformed seal members 20, 20A, 20B, 20C, 20D help mitigate the risk of improper sealing between the insert window 16 and the dead stop 22. Less installer training, retention, and attention will be required over all using the preformed seal members 20, 20A, 20B, 20C, 20D. The preformed seal members 20, 20A, 20B, 20C, 20D provide an easier and better performing insert window installation overall. The preformed seal members 20, 20A, 20B, 20C, 20D require less oversight, attention to application and much less time per projection window assembly 100 during installation of the insert windows 16.

Any of the features or attributes of the above the above described embodiments and variations can be used in combination with any of the other features and attributes of the above described embodiments and variations as desired.

It is apparent from the above detailed description of preferred embodiments of the present invention, that the above-disclosed dead stop type projection window assemblies 100 and the method for forming the dead stop type projection window assemblies 100, reduces or eliminates messy installations, improves product performance, cuts installation time dramatically, and eliminates all or all substantial use of sealant, particularly exposed exterior sealant that often fails and requires maintenance.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A dead stop projection window assembly comprising, in combination:

a free-standing frame including:

a top member;

a base member spaced below the top member;

at least two mullions vertically extending between the top member and the base member and spaced apart to form an insert window opening therebetween; and an internal and rearward-facing dead stop extending entirely about a perimeter of the insert window opening of the free-standing frame;

an independent insert window including a window frame extending about at least one window pane;

wherein the independent insert window is an off-the shelf window;

wherein the window frame of the independent insert window is secured to the free-standing frame at the insert window opening of the free-standing frame to prevent movement the window frame and the free-standing frame; and wherein the free-standing frame further includes at least one preformed seal member engaging the window frame of the independent insert window to seal closed the insert window opening of the free-standing frame.

2. The dead stop projection window assembly according to claim 1, wherein there is no sealant along the at least one preformed seal member forming a seal between the free-standing frame and the independent insert window to seal the insert window opening between the internal and rearward-facing dead stop and the independent insert window.

3. The dead stop projection window assembly according to claim 1, wherein the preformed seal member is extending from the internal and rearward-facing dead stop to seal the insert window opening between the internal and rearward-facing dead stop and the window frame of the independent insert window.

4. The dead stop projection window assembly according to claim 3, wherein the free-standing frame further includes another preformed seal member extending from at least one of the at least two mullions and engaging the window frame of the independent insert window to seal the insert window opening between the at least one two mullions and the independent insert window.

5. The dead stop projection window assembly according to claim 3, wherein the preformed seal member is secured to the internal and rearward-facing dead stop of the free-standing frame.

6. The dead stop projection window assembly according to claim 1, wherein the preformed seal member is extending from at least one of the at least two mullions to seal the insert window opening between the at least two mullions and the window frame of the independent insert window.

7. The dead stop projection window assembly according to claim 6, wherein the preformed seal member is attached to the at least two mullions of the free-standing frame.

8. The dead stop projection window assembly according to claim 1, wherein the preformed seal member is a flexible seal member that bends when engaged by the window frame of the independent insert window.

9. The dead stop projection window assembly according to claim 1, wherein the preformed seal member is a compressible member that compresses when engaged by the window frame of the independent insert window.

10. The dead stop projection window assembly according to claim 9, wherein the preformed seal member is foam gasket.

11. The dead stop projection window assembly according to claim 1, wherein the at least one preformed seal member forms a wind and water tight seal between the window frame of the independent insert window and the free-standing frame.

12. The dead stop projection window assembly according to claim 1, wherein the insert window opening of the free-standing frame is rectangular, there are at least two of the at least one preformed seal member, and the at least two preformed seal members extend along at least two edges of the insert window opening.

13. A method of assembling a dead stop projection window assembly comprising the steps of, in combination:

obtaining an independent insert window including a window frame extending about at least one window pane, wherein the independent insert window is an off-the shelf window;

obtaining a free-standing frame including a top member, a base member spaced below the top member, at least two mullions vertically extending between the top member and the base member and spaced apart to form an insert window opening therebetween, a dead stop extending entirely about a perimeter of the independent insert window opening; and at least one preformed seal member configured to engage the independent insert window when the independent insert window is closing the insert window opening to seal closed the independent insert window opening;

inserting the independent insert window into the free-standing frame at the insert window opening and pushing the independent insert window toward at the dead stop so that the window frame of the independent insert window engages the at least one preformed seal member to form a seal between the window frame of the independent insert window and the free-standing frame; and securing the window frame of the independent insert window to the free-standing frame at the insert window opening of the free-standing frame to close the insert window opening with the independent insert window and prevent movement between the window frame and the free-standing frame.

14. The method according to claim 13, wherein the at least one preformed seal member forms a wind and water tight seal between the window frame of the insert window and the free-standing frame.

15. The dead stop projection window assembly according to claim 12, wherein the at least two preformed seal members extend along at least lateral left and right edges of the independent insert window opening.

16. The method according to claim 13, wherein the insert window opening of the free-standing frame is rectangular, there are at least two of the at least one preformed seal member, and the at least two preformed seal members extend along at least two edges of the insert window opening.

17. The method according to claim 16, wherein the at least two preformed seal members extend along at least lateral left and right edges of the insert window opening.

18. The method according to claim 13, wherein the at least one preformed seal member is extending from the dead stop of the free-standing frame and engaging the window frame of the independent insert window to seal the insert window opening between the dead stop and the free-standing frame of the independent insert window.

19. The method according to claim 18, wherein the at least one preformed seal member is secured to the dead stop of the free-standing frame.

20. The method according to claim 13, wherein the at least one preformed seal member is a flexible seal member that bends when engaged by the window frame of the independent insert window.

* * * * *